US009394869B2

(12) United States Patent
Berg et al.

(10) Patent No.: US 9,394,869 B2
(45) Date of Patent: Jul. 19, 2016

(54) FUEL INJECTOR

(71) Applicant: Robert Bosch GmbH, Stuttgart (DE)

(72) Inventors: Anselm Berg, Ludwigsburg (DE); Olaf Schoenrock, Stuttgart-Weilimdorf (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/409,587

(22) PCT Filed: Apr. 24, 2013

(86) PCT No.: PCT/EP2013/058488
§ 371 (c)(1),
(2) Date: Dec. 19, 2014

(87) PCT Pub. No.: WO2013/189639
PCT Pub. Date: Dec. 27, 2013

(65) Prior Publication Data

US 2015/0176553 A1 Jun. 25, 2015

(30) Foreign Application Priority Data

Jun. 20, 2012 (DE) ..... 10 2012 210 424

(51) Int. Cl.
*F02M 51/06* (2006.01)
*F02M 61/20* (2006.01)
*F02M 63/00* (2006.01)

(52) U.S. Cl.
CPC ..... *F02M 51/0685* (2013.01); *F02M 51/0625* (2013.01); *F02M 61/20* (2013.01); *F02M 63/0075* (2013.01); *F02M 2200/304* (2013.01)

(58) Field of Classification Search
CPC ..... F02M 51/061; F02M 51/0625; F02M 51/0628; F02M 51/0685; F02M 61/20
See application file for complete search history.

(56) References Cited

U.S. PATENT DOCUMENTS

| | | | | | |
|---|---|---|---|---|---|
| 2,575,272 | A | * | 11/1951 | Harris | 251/30.04 |
| 3,632,081 | A | * | 1/1972 | Evans | 251/129.19 |
| 4,746,093 | A | * | 5/1988 | Scanderbeg | 251/30.04 |
| 5,048,790 | A | * | 9/1991 | Wells | 251/30.04 |
| 5,172,887 | A | * | 12/1992 | Cross et al. | 251/129.19 |

(Continued)

FOREIGN PATENT DOCUMENTS

| | | | |
|---|---|---|---|
| EP | 1460263 | | 9/2004 |
| JP | H08-210546 | A | 8/1996 |
| JP | H08-270827 | A | 10/1996 |

(Continued)

OTHER PUBLICATIONS

International Search Report for PCT/EP2013/058488, issued on Jun. 24, 2013.

*Primary Examiner* — Ryan Reis
(74) *Attorney, Agent, or Firm* — Norton Rose Fulbright US LLP

(57) ABSTRACT

A fuel injector, particularly for injecting fuel into a combustion chamber, is provided as including a housing having at least one spray orifice, an armature assembly that is movable linearly in the housing, along a longitudinal axis, a magnetic coil acting magnetically on the armature assembly, a valve element that is movable linearly with respect to the armature assembly and with respect to the housing, for opening and closing the spray orifice, and a pin for limiting the movement of the valve element with respect to the armature assembly.

10 Claims, 1 Drawing Sheet

(56) References Cited

U.S. PATENT DOCUMENTS

| | | | | |
|---|---|---|---|---|
| 5,899,194 | A * | 5/1999 | Iwatsuki et al. | 123/527 |
| 7,730,905 | B2 * | 6/2010 | Suzuki et al. | 137/613 |

FOREIGN PATENT DOCUMENTS

| | | | |
|---|---|---|---|
| JP | 2004-162813 | A | 6/2004 |
| JP | 2004-517255 | A | 6/2004 |
| JP | 2005-331111 | A | 12/2005 |
| JP | 4125295 | B2 | 7/2008 |
| JP | 2009079485 | A | 4/2009 |
| JP | 2010-180767 | A | 8/2010 |
| JP | 2010-223166 | A | 10/2010 |
| JP | 4820470 | B2 | 11/2011 |
| WO | WO02/12712 | | 2/2002 |
| WO | WO02/053906 | | 7/2002 |

* cited by examiner

FUEL INJECTOR

FIELD OF THE INVENTION

The present invention relates to a fuel injector, particularly for injecting fuel into a combustion chamber of an internal combustion engine.

BACKGROUND INFORMATION

Fuel injectors having a linearly movable valve needle and a corresponding magnet armature are known. The magnet armature is moved via a magnetic coil that is able to be supplied with current, and a pole body, in this instance. The valve needle is frequently separated from the magnet armature and connected via a spring, so that a two-mass system is created. Because of this, the valve needle has a so-called armature-free path, with respect to the magnet armature. The decoupling of the magnet armature from the valve needle leads to a reduction in the bounce, when the fuel injector is closed.

SUMMARY

The fuel injector according to the present invention shows a novel possibility of connecting the valve element to an armature assembly, a relative motion between the valve element and the armature assembly being further possible, so that a two-mass system is created. The valve element and the armature assembly are inserted in each other, according to the present invention, the relative motion between the armature assembly and the valve element being limited using a pin. This positioning according to the present invention also particularly enables the advantageous development of a damping chamber and/or the positioning of a pressure spring. Because of the development of the fuel injector according to the present invention, the bouncing behavior of the valve element is thus reduced, especially during the closing of the spray orifice. These advantages are achieved by a fuel injector including a housing, having at least one spray orifice and an armature assembly that is movable in the housing along a longitudinal axis. The armature assembly is moved using a magnetic coil that is able to have current applied to it. Furthermore, a valve element is provided in the housing, for opening and closing the at least one spray orifice, which is linearly movable with respect to the armature assembly and with respect to the housing. A pin is positioned so as to limit the relative motion between the valve element and the armature assembly.

It is preferably provided that the at least one pin is positioned perpendicular to the longitudinal axis. The pin may be connected either rigidly to the armature assembly or rigidly to the valve element. In a preferred embodiment, the valve element is lodged in the armature assembly. The pin is rigidly connected to the armature assembly and a recess, especially a bore, extends transversely to the longitudinal axis, in the valve element. This recess in the valve element is greater, in the direction of the longitudinal axis, than the diameter of the pin, so that the valve element is able to be moved to a limited extent with respect to the armature assembly.

Within the armature assembly, a damping chamber is preferably developed, for damping the motion of the valve element. When the fuel injector is used, this damping chamber is filled with fuel that is to be injected.

In a particularly preferred embodiment, the armature assembly includes a pot-shaped element. The pot-shaped element is formed by a bottom that is located perpendicular to the longitudinal axis and a sidewall encircling it. The pot-shaped element opens in the direction of the side facing the combustion chamber or rather the spray orifice. The valve element is lodged in this pot-shaped element. The valve element is guided in the pot-shaped element in a linearly movable manner. Between the bottom of the pot-shaped element and the valve element, the damping chamber is developed, in particular.

In order to set the damping effect, at least one discharge bore is preferably provided, for the fluid to be injected, in the bottom of the pot-shaped element.

Furthermore, a pressure spring is preferably positioned, which is supported at one end on the armature assembly and at the other end on the valve element. This pressure spring presses the valve element in the closing direction. In a particularly preferred manner, the pressure spring is situated between the valve element and the bottom of the pot-shaped element.

The armature assembly preferably has a hollow needle as central component. The fluid to be injected flows through this hollow needle. In a particularly preferred manner, at least one flow opening is provided for the fluid. At one end of the hollow needle facing away from the combustion chamber, a magnet armature is mounted which cooperates magnetically with an internal pole and with the magnetic coil. At the other end of the hollow needle, the pot-shaped element is inserted, and is connected in one material, in particular, for instance, using a welded connection, to the hollow needle.

In one further preferred specific embodiment, a shoulder is provided in the pot-shaped element. This shoulder represents an area facing the combustion chamber. An area facing away from the combustion chamber of the valve element is opposite to this area facing the combustion chamber. Between these two areas, a pinch gap is thus developed. During the motion of the armature assembly onto the valve element, this pinch gap becomes smaller. The damping effect is able to be set by an appropriate dimensioning of the pinch gap.

The pot-shaped element is produced particularly as a deep-drawn part. Alternatively, producing it as a turned part is provided.

The valve element preferably includes a small valve needle, which is rigidly connected to a sealing element, particularly a ball.

DETAILED DESCRIPTION

Figure 1:
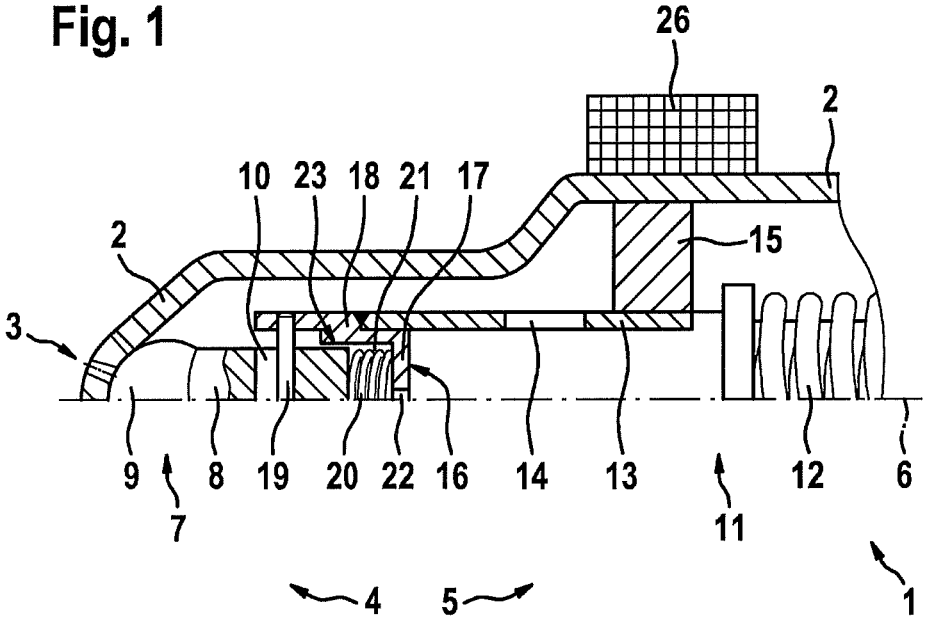
FIG. 1 shows a half section of a fuel injector according to the present invention according to a first exemplary embodiment.

FIG. 1 shows a fuel injector 1 according to the first exemplary embodiment, that is simplified in a half section and schematically.

Fuel injector 1 includes an only schematically shown housing 2 having at least one spray orifice 3. The side of fuel injector 1 having spray orifice 3 is designated as end 4 facing the combustion chamber. The other end of fuel injector 1 is designated as end 5 facing away from the combustion chamber. Fuel injector 1 extends along longitudinal axis 6. Along this longitudinal axis 6, a valve element 7 is situated, that is linearly movable within housing 2. Valve element 7 includes a short valve needle 8, which is rigidly connected to a ball valve 9. In valve needle 8, a recess 10 is developed as a bore situated perpendicular to longitudinal axis 6.

A magnetic coil 26, that is able to have current supplied to it, is mounted on housing 2.

Moreover, in housing 2 there is a linearly movable armature assembly 11 along longitudinal axis 6. Armature assembly 11 is movable using magnetic coil 26. Furthermore, armature assembly 11 is loaded by a closing pressure spring 12 in the closing direction and towards end 4 facing the combustion chamber. Armature assembly 11 includes a hollow needle 13 having at least one flow opening 14 for the fuel. On end 5 facing away from the combustion chamber, a magnet armature 15 is fastened on hollow needle 13. On end 4 facing the combustion chamber, a pot-shaped element 16 is lodged in hollow needle 13.

Pot-shaped element 16 is rigidly connected to hollow needle 13, particularly welded to it. Pot-shaped element 16 includes a bottom 17, which is located perpendicular to longitudinal axis 6. Adjacent to bottom 17, there is a cylindrical sidewall 18 of pot-shaped element 16.

Pot-shaped element 16 opens in the direction of side 4 facing the combustion chamber. Valve element 7 is lodged in pot-shaped element 16, in particular, short valve needle 8. A pin 19 is rigidly connected to sidewall 18. Pin 19 extends perpendicular to longitudinal axis 6 into recess 10 in short valve needle 8. A movement of valve element 7 with respect to pot-shaped element 16 is limited by this pin 19.

Between bottom 17 of pot-shaped body 16 and an end facing away from the combustion chamber, of valve element 7, a pressure spring 20 is situated. Furthermore, the space between the end of valve element 7 facing away from the combustion chamber and bottom 17 is used as damping chamber 21 for the opening motion of valve element 7. In order to set the appropriate damping effect, at least one discharge bore 22 is provided in bottom 17. Discharge bore 22 is dimensioned according to the desired damping effect.

Short valve needle 8 is guided along a guidance 23 on sidewall 18.

Figure 2:
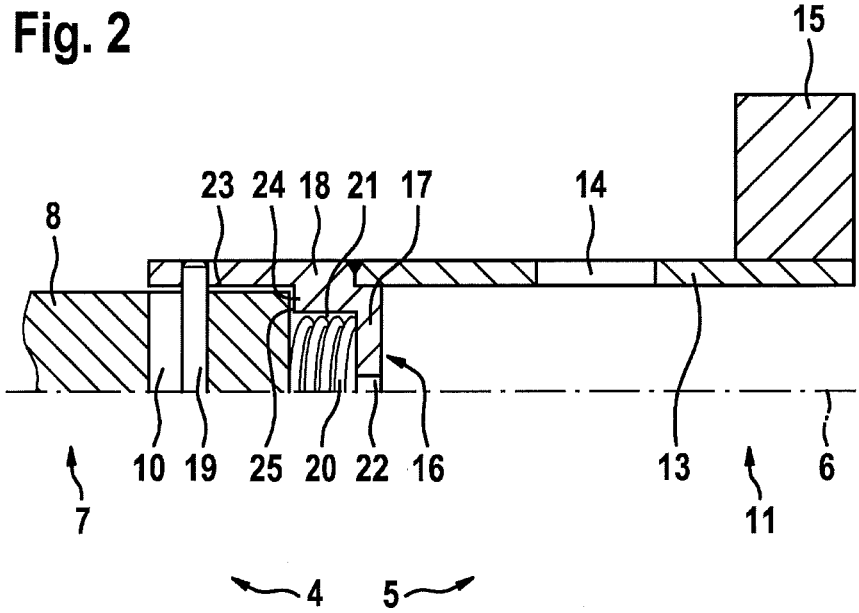
FIG. 2 shows a detail in the half section of the fuel injector according to the present invention, according to a second exemplary embodiment.

FIG. 2 shows a detailed cutout of fuel injector 1 according to the second exemplary embodiment. Identical components or functionally identical components are designated by identical reference symbols in the exemplary embodiments.

By difference from the first exemplary embodiment, in the second exemplary embodiment, the pot-shaped element includes a shoulder 24 at its sidewall 18. Shoulder 24 forms an annular area facing the combustion chamber. Between this annular area and the area facing away from the combustion chamber of valve needle 8, a pinch gap 25 is developed. The damping effect of damping chamber 21 is also able to be regulated via this pinch gap 25.

In the second exemplary embodiment, the damping effect is able to be adjusted both using pinch gap 25 and using the dimensioning of damping chamber 21 by using discharge bore 22.

In the state of magnetic coil 26 not supplied with current, armature assembly 11 is pressed, using closing pressure spring 12, onto valve element 7 against pressure spring 20, so that ball valve 9 seals spray orifice 3. After the beginning of the current supply, that is, as soon as the magnetic force is greater than the force of closing pressure spring 12 minus the force of pressure spring 20, armature assembly 11 is accelerated in the opening direction, especially in the direction of an internal pole (not shown), until pin 16 impacts against a wall of recess 10 in valve needle 8, and the impulse is transmitted to valve element 7.

Upon closing, the following functional sequence comes about: As soon as ball valve 9 touches the sealing seat, armature assembly 11 is able to move farther in the closing direction. In this context, armature assembly 11 is braked by pressure spring 20. In addition, a pressure builds up between valve element 7 and bottom 17 of pot-shaped element 16, that is, in damping chamber 21, which is dissipated via pinch gap 25 and/or discharge bore 22. The diameter of discharge bore 22 and the size of pinch gap 25, as well as the dimensioning of the entire damping chamber 21, define the damping that valve element 7 and armature assembly 11 experience.

What is claimed is:

1. A fuel injector, comprising:

a housing having at least one spray orifice;

an armature assembly that is linearly movable in the housing along a longitudinal axis, wherein the armature assembly has at least one fuel opening;

a magnetic coil acting magnetically on the armature assembly;

a valve element that is linearly-movable with respect to the armature assembly and with respect to the housing, for opening and closing the spray orifice;

a pin for limiting the movement of valve element with respect to the armature assembly, wherein the pin crosses the valve element from a first side of the armature assembly to a second side of the armature assembly; and a damping chamber, in the armature assembly, that is able to be filled with fuel, for damping a movement of the armature assembly with respect to the valve element.

2. The fuel injector as recited in claim 1, wherein the fuel injector is for injecting fuel into a combustion chamber.

3. The fuel injector as recited in claim 1, wherein the pin rests perpendicular to the longitudinal axis.

4. The fuel injector as recited in claim 1, wherein the pin is connected one of rigidly to the armature assembly and rigidly to the valve element.

5. A fuel injector, comprising:

a housing having at least one spray orifice;

an armature assembly that is linearly movable in the housing along a longitudinal axis, wherein the armature assembly has at least one fuel opening;

a magnetic coil acting magnetically on the armature assembly;

a valve element that is linearly movable with respect to the armature assembly and with respect to the housing, for opening and closing the spray orifice; and a pin for limiting the movement of the valve element with respect to the armature assembly, wherein the pin crosses the valve element from a first side of the armature assembly to a second side of the armature assembly;

wherein the armature assembly includes a pot-shaped element, in which the valve element is lodged and in which a damping chamber is developed.

6. The fuel injector as recited in claim 5, further comprising:

a pressure spring, between the armature assembly and the valve element, that presses the valve element in a closing direction.

7. The fuel injector as recited in claim 6, wherein the pressure spring is situated in the pot-shaped element.

8. The fuel injector as recited in claim 5, wherein at least one discharge opening is disposed in a bottom of the pot-shaped element.

9. The fuel injector as recited in claim 5, wherein the armature assembly includes a hollow needle, a magnet armature and the pot-shaped element being mounted on the hollow needle.

10. The fuel injector as recited in claim 5, wherein a shoulder in the pot-shaped element is for developing a pinch gap between the shoulder and the valve element.

* * * * *